United States Patent [19]

White

[11] 4,086,713

[45] May 2, 1978

[54] DIGGER TOOTH RETAINER

[75] Inventor: Kenneth M. White, Calgary, Canada

[73] Assignee: Western Rock Bit Co., Ltd., Calgary, Canada

[21] Appl. No.: 758,356

[22] Filed: Jan. 10, 1977

[30] Foreign Application Priority Data

May 27, 1976 Canada ..... 253465

[51] Int. Cl.[2] ..... E02F 9/28

[52] U.S. Cl. ..... 37/142 A; 403/226; 299/92

[58] Field of Search ..... 37/141 R, 141 T, 142 R, 37/142 A; 299/91, 92; 403/223, 225–227

[56] References Cited

U.S. PATENT DOCUMENTS

| | | | |
|---|---|---|---|
| 2,043,442 | 6/1936 | NcNeil | 37/142 A |
| 2,256,488 | 9/1941 | Murtaugh | 37/142 R |
| 3,400,476 | 9/1968 | Petersen | 37/142 A |
| 3,511,289 | 5/1970 | Coyle | 37/142 A X |
| 3,690,728 | 9/1972 | Krekeler | 299/92 |

FOREIGN PATENT DOCUMENTS

| | | | |
|---|---|---|---|
| 2,261,910 | 7/1973 | Germany | 37/142 A |

*Primary Examiner*—E. H. Eickholt

[57] ABSTRACT

A retainer for retaining a shank in a recess. The retainer is in the form of a resilient collar having an inner surface co-acting with the shank and a peripheral surface co-acting with the walls of the recess. The peripheral surface is eccentrically displaced with respect to the inner surface. The inner surface of the retainer and the co-acting surface of the shank have complementary regular polygonal shapes.

3 Claims, 7 Drawing Figures

DIGGER TOOTH RETAINER

BACKGROUND OF THE INVENTION

This invention relates to resilient means adapted for retaining a shank in a recess.

Digger teeth of the type comprising an excavating portion and a bifurcated shank portion adapted for co-acting with a digger tooth holder are well known in the art. Resilient means for retaining a digger tooth in a digger tooth holder are also well known. With the presently available type of resilient retaining means and teeth, the holding force between a particular tooth and the holder is established at the factory and hence any stretch or wear on the resilient retainer or holder cannot be compensated for in the field. Further, a retainer, such as disclosed in U.S. Pat. No. 2,968,880, allows the tooth to pivot in the holder so that its shanks are subjected to dynamic shock loading when irregular material is being excavated.

SUMMARY OF THE INVENTION

According to one aspect of this invention, there is provided the combination of a digger tooth, a digger tooth holder, and a digger tooth retaining means; said holder incorporating two spaced recesses; said tooth comprising a tip portion adapted for excavating and a shank portion adapted for co-acting with said holder; said shank portion comprising two shanks separated by a generally rectangular slot; said shanks each being receivable in one of said recesses; said retaining means comprising two resilient collars, each having an inner surface adapted for co-acting with one of said shanks and a peripheral surface adapted for co-acting with the walls of one of said recesses; said peripheral surfaces being eccentrically displaced with respect to said inner surfaces; the inner surfaces of the retaining means and co-acting surfaces of the shanks having complementary regular polygonal shapes.

In a preferred construction the inner surface of the retaining means is relieved to allow for material displacement in the retaining means during insertion of the shank into the recess.

For example, the relief means may comprise a recess in the inner surface of the retaining means at the region of maximum thickness and surface eccentricity of the retaining means; the lateral extent of the recess being generally equal to a side of the polygonal shape.

Desirably, the retaining means can be rotated relative to the shank, such that the region of maximum thickness and surface eccentricity of the retaining means can be changed to compensate for wear and dimensional variations between the shank and walls of the recess.

According to another aspect of this invention, there is provided a digger tooth for use in combination with a resilient tooth retainer collar having an inner surface of polygonal cross-section when viewed in the axial direction of said collar and a digger tooth holder having two recesses therein to accommodate shanks of said tooth, said digger tooth comprising a tip portion adapted for excavating and a shank portion, said shank portion comprising two shanks separated by a generally rectangular slot, each shank having an annular groove therearound intermediate the ends thereof, the bottom surface of each groove, when viewed in cross-section of said shank, being of complementary polygonal shape to the cross-sectional shape of said inner surface of said collar.

Rotation of the resilient retainer collar and thus a change in the angular position of the wall surface eccentricity effects adjustment of the retaining force allowing in-field compensation for stretch, wear, and dimensional variations between the shank and the recess. This adjustment allows a preloading of a digger tooth so that there is a gradual increase in load as opposed to the shock load that is encountered using conventional retainers.

Digger teeth using a resilient retainer according to the invention are economical to produce since large manufacturing tolerances can be compensated for by the retainer. The holders are economical to produce and use in that no holes are required to accommodate the retainers and large manufacturing tolerances can be compensated for. Economical field operations are possible in that, with each new tooth, a new retainer is supplied and wear variations between holders can be compensated for readily.

The relieving of the inner surface of the retainer allows for the displacement of the resilient material during insertion of the shank into the recess. It is preferred that the width of the relief notch equal the length of one side of the polygonal portion of the shank and that it be located at the point of maximum eccentricity and wall thickness of the retainer. This is so that, under compression of the retainer, a vertical as well as a horizontal holding force is generated.

When the resilient retainer is employed on a digger tooth of the type described, compensation for stretch in the digger tooth holder is made by rotating the retainer relative to the digger tooth so that the maximum eccentricity of the retainer is in alignment with the maximum stretch on the holder. The retaining force generated has a component directed toward the center of the tooth as well as a component in the direction of the maximum stretch. The force component in the direction of stretch preloads the tooth so that, when excavating force reversal occurs, there is a gradual build up on the tooth and retainer.

BRIEF DESCRIPTION OF THE DRAWINGS

In drawings which illustrate embodiments of the invention which should not be taken as limiting the scope of the invention.

DETAILED DESCRIPTION OF PREFERRED EMBODIMENTS

Figure 1:
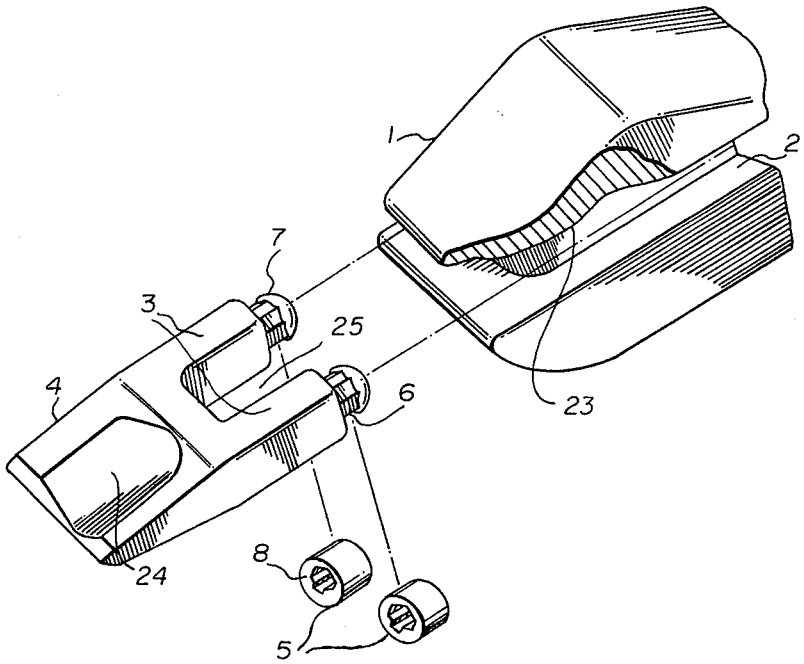
FIG. 1 is an exploded assembly of a digger tooth and holder.

Referring to FIG. 1, a digger tooth 4 comprises a tip portion 24, adapted for excavating and a shank portion comprising two shanks 3, separated by a rectangular slot 25, and adapted for insertion into a holder 1. The holder 1 comprises a central portion 23 incorporating two recesses 2, one of which is shown. Each shank 3 is receivable in one of the recesses 2. Collar-shaped retainers 5 are adapted to fit an octagonal portion 6 on the shanks 3. The portions 7 on the shanks 3 have substantially circular cross-sections and serve to prevent axial displacement of the retainers 5 from the shanks 3 during removal of the tooth from the holder. Complementary octagonal holes 8 are provided in the retainers 5 so that each retainer may be rotated to eight angular positions relative to a tooth. The retainers can be rotated to new angular positions relative to the tooth with no special tools, but the holding force generated by the co-acting octagonal flats prevents rotation of the retainer during insertion of the tooth into the holder.

Figure 2:
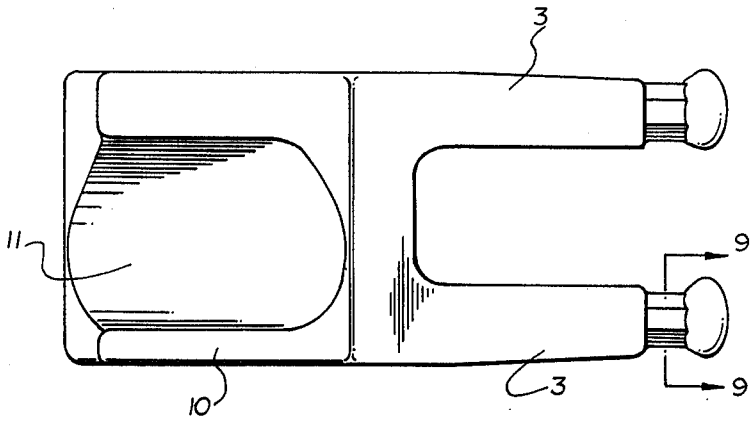
FIG. 2 is a a tooth in plan view.

The plan view of the tooth shown in FIG. 2 shows shanks 3 of a substantially rectangular shape. A cutting portion 10 of the tooth is basically wedge-shaped with relieved areas 11 providing improved excavation efficiency.

Figure 3:
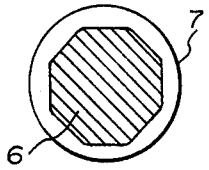
FIG. 3 is a section on line 9—9 of the tooth of FIG. 2.

Referring to FIG. 3, octagonal portion 6 of the shank is adapted to co-act with the internal octagonal surface 8 of the retainer 5.

Figure 4:
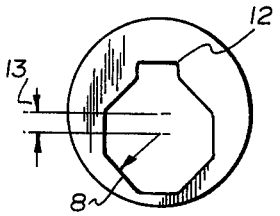
FIG. 4 is an enlarged end view of a retainer.

Referring to FIG. 4, octagonal surface 8 has relief provided at 12 for material displacement during tooth insertion. The relief comprises a recess in the inner surface of the retainer 5 at its point of maximum thickness and surface eccentricity. The lateral extent of the recess is generally equal to a side of the octagonal shape. The eccentricity of the octagonal surface 8, relative to the circular periphery, is indicated at 13. The eccentricity 13 is determined as a function of the manufacturing tolerance between the shanks 3 of the tooth and the central portion of the holder 1.

Figure 5:
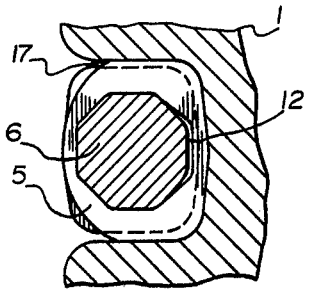
FIG. 5 shows a retainer installed in a holder that is neither worn nor stretched and as viewed through a section equivalent to section 9—9 of FIG. 2.

The holder-shank combination illustrated in FIG. 5 shows the holder 1 in section with a retainer 5 on an octagonal portion 6 of a shank 3. The clearance space 17 surrounding the shank portion 6 is the normal manufacturing tolerance. The retainer 5 has relief 12 reduced from the size shown in FIG. 4 due to the compressive force on the retainer 5 from the installation of the shank 3 into the holder 1. The retainer 5 is of a size that, under compressive force due to installation, the substantially circular circumference is forced to conform to the shape of the shank recess 2.

Figure 6:
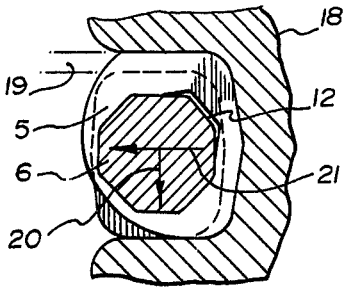
FIG. 6 shows a retainer installed in a worn recess.

The holder 18 in FIG. 6 is worn so that the clearance space 19 is larger than when the tooth and holder are new. The retainer 5, shown in FIG. 6, has been rotated relative to the shank 6 so that relief 12 is located where shown. This is not the position for maximum wear compensation. The point of maximum wear compensation occurs when the relief 12 is rotated 90° from the position indicated in FIG. 5. In the position shown in FIG. 6, there is a force component on the tooth shank 6 in the directions 20 and 21. The force component in direction 20 is particularly important in preventing tooth breakage due to cutting force reversal. The force component 20 holds one shank surface against the holder 18 so that dynamic shock loading of the shank is prevented. Under force reversal, the retainer must be compressed before the shank contacts the opposite side of the holder recess; this inhibits dynamic shock loading of the shank in the opposite direction.

Figure 4A:
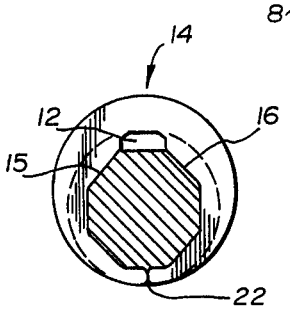
FIG. 4*a* shows another retainer installed on a tooth.

Another embodiment of the retainer is shown installed on a tooth shank in FIG. 4*a*. A longitudinal split 22 is provided in the retainer to facilitate installation of the retainer over the octagonal portion of the shank. This feature allows a comparatively rigid elastomer to be used for the retainer so that a force applied at 14 will cause a displacement at relief 12 while the retainer material is being displaced along octagonal faces 15 and 16. The material displacement along faces 15 and 16 generates a biaxial force on the tooth shank and holder as with the embodiment of FIG. 6.

What I claim is:

1. The combination of a digger tooth, a digger tooth holder, and a digger tooth retaining means; said holder incorporating two spaced recesses; said tooth comprising a tip portion adapted for excavating and a shank portion adapted for co-acting with said holder; said shank portion comprising two shanks separated by a generally rectangular slot; said shanks each being receivable in one of said recesses; said retaining means comprising two resilient collars, each having an inner surface adapted for co-acting with one of said shanks and a peripheral surface adapted for co-acting with the walls of one of said recesses; said peripheral surfaces being eccentrically displaced with respect to said inner surfaces; the inner surfaces of the retaining means and co-acting surfaces of the shanks having complementary regular polygonal shapes.

2. The combination of claim 1 wherein the inner surfaces of the retaining means are relieved to allow for material displacement in the retaining means during insertion of the shank into the recess.

3. The combination of claim 1, wherein the retaining means can be rotated relative to the shanks such that the angular position of maximum thickness and surface eccentricity of the retaining means can be changed to compensate for wear and dimensional variations between the shanks and recesses.

* * * * *